US007371112B2

(12) United States Patent
Burris et al.

(10) Patent No.: US 7,371,112 B2
(45) Date of Patent: May 13, 2008

(54) COAXIAL CONNECTOR AND COAXIAL CABLE CONNECTOR ASSEMBLY AND RELATED METHOD

(75) Inventors: Donald Andrew Burris, Peoria, AZ (US); William Bernard Lutz, Glendale, AZ (US); Kenneth Steven Wood, Elmira, NY (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/499,173

(22) Filed: Aug. 4, 2006

(65) Prior Publication Data

US 2008/0032551 A1 Feb. 7, 2008

(51) Int. Cl.
*H01R 9/05* (2006.01)

(52) U.S. Cl. ..... 439/578; 29/828; 29/857; 29/861

(58) Field of Classification Search ..... 439/578–585; 29/828, 857, 861, 862
See application file for complete search history.

(56) References Cited

U.S. PATENT DOCUMENTS

| | | | | |
|---|---|---|---|---|
| 3,297,979 A | | 1/1967 | O'Keefe et al. | 339/177 |
| 4,059,330 A | * | 11/1977 | Shirey | 439/578 |
| 4,400,050 A | | 8/1983 | Hayward | 339/177 R |
| 4,834,675 A | | 5/1989 | Samchisen | 439/578 |
| 5,002,503 A | | 3/1991 | Campbell et al. | 439/578 |
| 5,338,225 A | | 8/1994 | Jacobsen et al. | 439/585 |
| 5,595,502 A | * | 1/1997 | Allison | 439/429 |
| 5,632,651 A | | 5/1997 | Szegda | 439/578 |
| 5,802,710 A | * | 9/1998 | Bufanda et al. | 29/828 |
| 6,210,222 B1 | | 4/2001 | Langham et al. | 439/583 |
| 6,790,081 B2 | | 9/2004 | Burris et al. | 439/578 |
| 6,916,200 B2 | | 7/2005 | Burris et al. | 439/578 |
| 2005/0159044 A1 | | 7/2005 | Harwath et al. | 439/578 |
| 2007/0066134 A1 | * | 3/2007 | Burris et al. | 439/578 |
| 2007/0123102 A1 | * | 5/2007 | Hara | 439/595 |
| 2007/0155232 A1 | * | 7/2007 | Burris et al. | 439/578 |

* cited by examiner

*Primary Examiner*—Gary F. Paumen
(74) *Attorney, Agent, or Firm*—Joseph M. Homa; Matthew J. Mason

(57) ABSTRACT

A method of making a coaxial cable assembly is disclosed, the assembly comprising a coaxial cable and a connector, or connector termination, on at least one end of the cable. A connector, comprised of connector components, is also disclosed. The method comprises placing connector components into contact with the cable before the connector components are assembled into a connector. The connector is assembled simultaneously with securing the connector to the cable to make a coaxial cable assembly. A method of preparing coaxial cable in a manner suitable for making coaxial cable assemblies is also disclosed. The coaxial cable assembly can be a jumper, or a lead.

20 Claims, 10 Drawing Sheets

COAXIAL CONNECTOR AND COAXIAL CABLE CONNECTOR ASSEMBLY AND RELATED METHOD

BACKGROUND OF THE INVENTION

1. Field of the Invention

The present invention relates generally to coaxial cable connectors and coaxial cable/connector assemblies, and particularly to coaxial cable connectors suitable for coaxial assemblies.

2. Technical Background

Coaxial cable connectors such as F-connectors are used to attach coaxial cable to another object such as an appliance or junction having a terminal adapted to engage the connector. F-connectors are often used in conjunction with a length of coaxial cable to create a jumper cable assembly to interconnect components of a cable television system. A jumper typically has one coaxial connector (connector termination) at each end of the length of cable. The coaxial cable typically includes a center conductor, or inner conductor, surrounded by a plurality of outer cable components, for example the inner conductor is surrounded by a dielectric, in turn surrounded by one or more outer conductive layers, or metallic layers, such as a conductive grounding foil and/or braid, wherein the outer conductive arrangement is itself surrounded by a protective outer jacket. The dielectric can be plastic, rubber, glass, or ceramic. Various types of coaxial cable have different outer protective layers or jackets. The F-connector is typically secured over the prepared end of the jacketed coaxial cable by use of a crimp tool or compression tool specifically designed to crimp or actuate the connector. Once secured to the coaxial cable, the connector is then capable of transferring signals by engaging the connector with a threaded connection or threaded port, such as found on typical CATV electronic devices like set top converters, television sets or DVD players.

Crimp style F-connectors are known wherein a crimp sleeve is included as part of the connector body. A crimping tool must be used to deform the crimp sleeve onto the cable to secure the connector to a cable. For example, a special radial crimping tool, having jaws that form a hexagon, can be used to radially crimp the crimp sleeve around the outer jacket of the coaxial cable to secure such a crimp style F-connector over the prepared end of the coaxial cable, such as described in U.S. Pat. No. 4,400,050 to Hayward. However, crimping braided outer conductors can present some difficulties. To prevent deformation of the outer cable components in relation to the center conductor, a support sleeve of one form or another may be used. Usually, the braid is captured in a layer between a tubular outer ferrule and the connector body, wherein the outer ferrule is crimped onto the crimp sleeve which in turn is radially compressed into engagement with the cable, but such crimps are not typically considered to be highly reliable, because, for example, there are typically large voids in the interface allowing for corrosive degradation of the contact surfaces, and/or the mechanical pull strength to the joint does not approach the strength of the wire. Additionally, such a crimp connection typically allows relative movement between all three components, which results in a very poor, noisy electrical connection.

Another known form of F-connector includes an annular compression sleeve used to secure the F-connector over the prepared end of the cable. Rather than crimping a crimp sleeve radially toward the jacket of the coaxial cable, these F-connectors employ an annular compression sleeve, typically plastic, that is initially attached to the F-connector, but which is detached therefrom prior to installation of the F-connector. The compression sleeve includes an inner bore for allowing such compression sleeve to be passed over the end of the coaxial cable prior to installation of the F-connector. The remainder of the F-connector itself is then inserted over the prepared end of the coaxial cable. Next, the compression sleeve is compressed axially along the longitudinal axis of the connector into the body of the connector, which simultaneously causes the jacket of the coaxial cable to be compressed between the compression sleeve and the tubular post of the connector as the compression sleeve moves radially inward. An example of such a compression sleeve F-connector is described in U.S. Pat. No. 4,834,675 to Samchisen. A number of commercial tool manufacturers provide compression tools for axially compressing the compression sleeve into such connectors.

Standardized cable preparation tooling and connector actuation tooling have lead to a de facto standard in cable preparation dimensions and connector envelope configurations. Additional requirements for both in-door and out-door use have resulted in connector designs that require a relatively large number of components. While standardized cable preparation tooling and connector actuation tooling has increased flexibility and interchangeability in field installations where an installer is concerned with making cable connection using one or a few connectors at a particular location, the implementation of these standardized connector and tooling systems for the manufacture of cable assemblies such as CATV jumper cables in large quantities tends to limit the efficiency of mass assembly of the jumpers, thereby causing unnecessary expense to be incurred in the manufacture of the assemblies.

FIGS. 1A-1C are partial cutaway views along the centerline of a coaxial cable illustrating typical known in-field cable preparation. FIG. 1A shows cable 100 comprising center conductor 101, dielectric 102 surrounding and in contact with the center conductor 101, outer conductor or shield 103 surrounding and in contact with dielectric 102, braid 104 surrounding and in contact with shield 103, and jacket 105 surrounding and in contact with braid 104. Basic preparation techniques are noted in steps 1 through 3. FIG. 1A shows cable 100 cut out to a desired length. FIG. 1B shows the result of removing outer cable components to expose center conductor 101 and braid 103. The standard exposed length of braid 106 is ¼", and the standard exposed length of center conductor 107 is 5⁄16". A multitude of industry standard tools are available to perform the necessary cuts to achieve the "standard" dimensions illustrated in FIG. 1B. FIG. 1C shows the result of un-weaving of braid 104 and folding back of braid 104 along jacket 105, which is typically performed manually and requires dexterity and time to accomplish properly.

FIG. 2 is a side cutaway view along the centerline of a known connector/cable combination. Connector 200 shown in FIG. 2 illustrates a relatively high number (six) of component parts required to meet the combined indoor and outdoor functional requirements placed on many F connectors. Additionally, FIG. 2 illustrates a difference in outer diameter between the outermost diameters of coupling nut 201 and body 204, which provides a relatively small exposed region E1 of the proximal side of coupling nut 201 in which to grasp the coupler 201 during installation. A limited difference in outer diameter E1 (and the resulting limited area of exposure) can be somewhat mitigated by increasing clearance space 207 defined by the rear end 208 of the coupler 201 and the outer surface of body 204, wherein space 207 can allow installer fingers a greater purchase area, but may not provide an entirely satisfactory solution, particularly if coupling nut 201 is plated with a relatively low coefficient of friction, or slippery, material, such as nickel. Clearance space 207 can be somewhat useful for pushing coupling nut 201 forward during installation, but more access to the back of coupling nut 201 but would be more advantageous. However, couplers are typically provided in standard sizes, and, for given standard coupler sizes, practical limits exist on reducing the outer diameter of the body of known connectors (for example because such connectors need to be able to receive the folded back braid of the cable and need to be able to clamp onto the cable, the outside diameter of the body needs to be large enough to structurally accommodate those features), so limitations exist on the flexibility of increasing the difference in outer diameter E1 in known connectors, used in conjunction with known cable preparation methods.

SUMMARY OF THE INVENTION

Disclosed herein is a method of making a coaxial cable assembly, the assembly comprising a coaxial cable and a connector, or connector termination, at least one end of the cable. Connectors, comprised of connector components, are also disclosed herein. The method comprises placing connector components into contact with the cable before the connector components are assembled into a connector. The connector is assembled simultaneously with securing the connector to the cable to make a coaxial cable assembly. The coaxial cable assembly can be a jumper or a lead.

The connectors disclosed herein are comprised of a small number of components that can be installed on a coaxial connector cable in an extremely efficient manner in terms of time, labor, and material costs. Additionally, such connectors are easy to use as a cable termination, such as when applied as in a connector/cable assembly such as a jumper assembly, while providing provide necessary signal shielding and sufficient retention on the coaxial cable. The method of installing the connector onto coaxial cable permits flexibility and interchangeability during assembly, where, for example, various types and/or sizes of couplers can be matched with various shells and/or posts, which would not otherwise be available with connectors that require pre-assembly before attachment to a cable.

In one aspect, a method of making a coaxial cable assembly is disclose that includes passing an end of a coaxial cable through an internal bore in a tubular shell and an internal bore of a coupler, wherein the coaxial cable has a longitudinal axis, inserting a first portion of a tubular post axially into the end of the coaxial cable, wherein the tubular shell and the coupler are axially spaced away from the first portion of the post, and the shell does not surround the first portion of the post, moving the tubular shell and the coupler axially relative to the post and the coaxial cable, wherein at least part of the tubular shell surrounds at least part of the tubular post and wherein at least a portion of the coupler surrounds at least a part of the tubular shell and the coaxial cable.

In another aspect, a method of making a coaxial cable assembly is disclosed herein, the method including passing an end of a coaxial cable through an internal bore in a tubular shell and an internal bore of a coupler, inserting a tubular post into the end of the coaxial cable, wherein the tubular shell and the coupler are spaced away from the post, and the shell and the coupler does not surround the post, and moving the shell and the post together sufficient to surround at least part of the post with at least part of the shell.

In some embodiments, before the inserting step, the shell is capable of sliding over the cable disposed within the internal bore of the shell. In some embodiments, the moving step further comprises bringing the shell into direct mechanical contact with the post. In some embodiments, the inserting step further comprises raising a raised portion of the cable radially outwardly; preferably, in the moving step, at least part of the raised portion of the cable is disposed between the at least part of the post and the at least part of the shell. In some embodiments, after the moving step, the shell limits movement of the coupler. In other embodiments movement of the coupler is limited by the tubular post.

In another aspect, a method of making a coaxial cable assembly is disclosed herein, the method including providing a length of coaxial cable having an end, the cable comprising an inner conductor and outer components surrounding the inner conductor, the outer components comprising a first outer component surrounded by a second outer component, providing a tubular shell, a tubular post, and a coupler, inserting the end of the cable into a first end of the tubular shell, inserting a back end of the tubular post into the end of the cable, wherein the back end is wedged between the first outer component and the second outer component of the cable, and moving the tubular shell axially toward the front end of the post sufficient for the shell to surround at least a portion of the tubular post, thereby causing the shell and the post to transmit a compressive force to the second outer component sufficient to secure the shell and the post onto the cable.

In another aspect, a coaxial connector is disclosed herein, the coaxial connector including a tubular shell, the tubular shell having an internal bore to receive a coaxial cable therethrough and a deformable lip at a front end, a tubular post having an internal bore to receive at least a portion of the coaxial cable, the tubular post also having an outer surface with at least one inclined surface and an annular collar at a front end thereof to engage the front end of the tubular shell, a coupler having an internal bore to receive the coaxial cable and at least a portion of the tubular shell therein, the internal bore also having an annular recess adjacent a rear portion, wherein the deformable lip on the tubular shell is deformed radially outward and into the annular recess of the coupler by the inclined surface of the tubular post as the tubular shell is moved over the coaxial cable and press fit onto the tubular post.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1A:
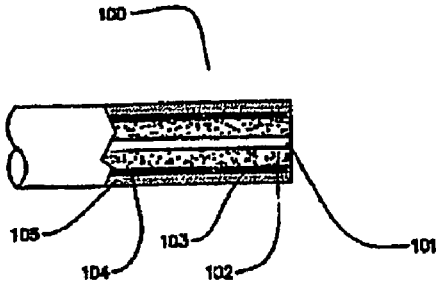
FIG. 1A shows a partial cross sectional view of an end of a coaxial cable.
Figure 1B:
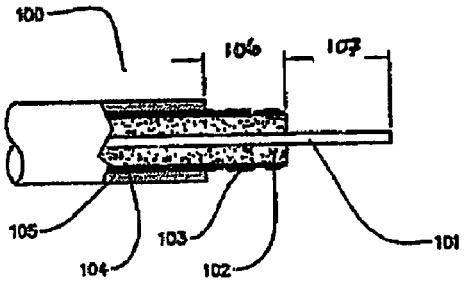
FIG. 1B (PRIOR ART)
FIG. 1B shows the cable of FIG. 1A with outer cable components removed to expose the braid and the center conductor.
Figure 1C:
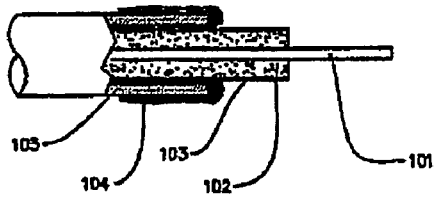
FIG. 1C (PRIOR ART)
FIG. 1C shows the cable of FIG. 1B with the braid folded back over the jacket.
Figure 2:
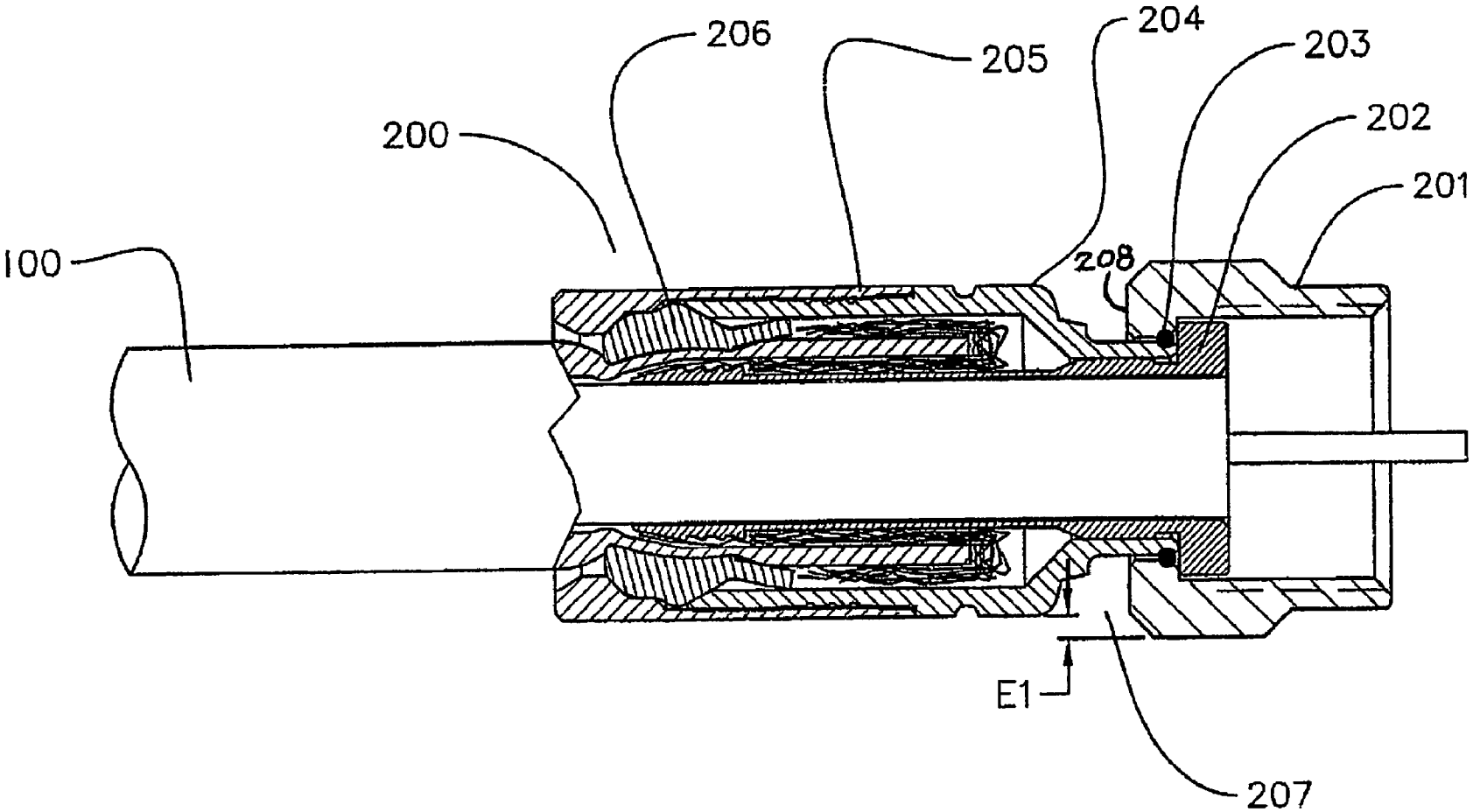
FIG. 2 (PRIOR ART)
FIG. 2 is a partial cross sectional view of a coaxial connector connected to a cable prepared according to a known method.

Reference will now be made in detail to the present preferred embodiment(s) of the invention, examples of which are illustrated in the accompanying drawings. Whenever possible, the same reference numerals will be used throughout the drawings to refer to the same or like parts.

Figure 3A:
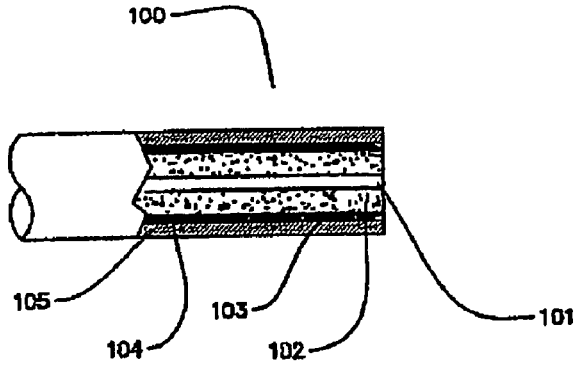
FIGS. 3A-3C are partial cross sectional views of a coaxial cable illustrating the cable preparation method according to one embodiment of the present invention.
Figure 3B:
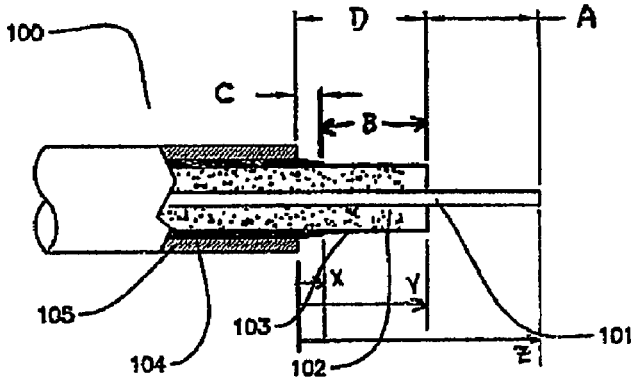
Figure 3C:
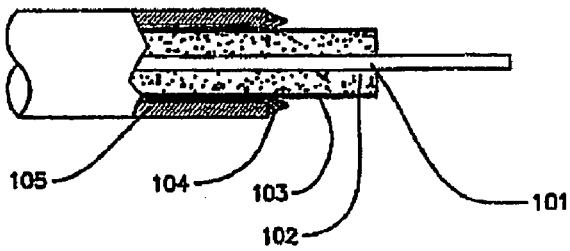

FIGS. 3A-3C are partial cutaway views along the centerline of a coaxial cable illustrating the cable preparation method as disclosed herein. FIG. 3A shows cable 100 comprising center conductor 101, dielectric 102, outer conductor or shield 103, braid 104, and jacket 105. For some embodiments, such as a coaxial cable jumper, a desired length of cable 100 is cut, preferably making a clean cut. Referring to FIG. 3B with a desired length of cable 100, the cable preparation includes removing a portion of the protective layer 105, a portion of the braid 104, and a portion of the dielectric 102 from the end of the coaxial cable to provide a prepared end of the cable, which can be effected using one or more known tools, wherein the prepared end comprises: a protective layer cut edge 110; a protruding portion of the braid 104 that protrudes a length X from the cut edge 110 of the protective layer 105, a protruding portion of the dielectric 102 that protrudes a length Y from the cut edge 110 of the protective layer 105, and a protruding portion of the inner conductor 101 that protrudes a length Z from the cut edge 110 of the protective layer 105, wherein the ratio of X/Y is less than 1, preferably less than 0.5, more preferably less than 0.25. Thus, the cable preparation includes removing outer components of the cable 100, such as dielectric 102, outer conductor or shield 103, braid 104, and/or jacket 105, as appropriate, to expose a length A of the center conductor 101, and to expose a length B of the shield 103, and to expose a length C of the braid 103, wherein the shield 103 and dielectric protrude beyond the end of the cable jacket 105 for a length D, where D=B+C, and the tip of the center conductor is disposed a length E away from the end of the cable jacket 105, where E=A+B+C=A+D, wherein the ratio of C/B is less than 1, preferably less than 0.5, more preferably less than 0.25. In some embodiments, the method further comprises the step of lifting at least a portion of the exposed length C of braid 104 radially outwardly, e.g. away from shield 103, preferably toward the end of jacket 105. In some embodiments, the lifting comprises flaring at least a portion of the exposed length C of braid 104 away from shield 103, for example by applying a tool having a conically tapered portion to the cable 100 and under exposed length C, or by applying part of the connector to the cable during connection of the connector onto the cable.

Even if desired dimensions for cable preparation disclosed herein are not readily achievable by use of industry standard available tooling intended for use in the field by a single installer, such desired dimension can be easily achieved by high speed factory production tooling.

Figure 4:
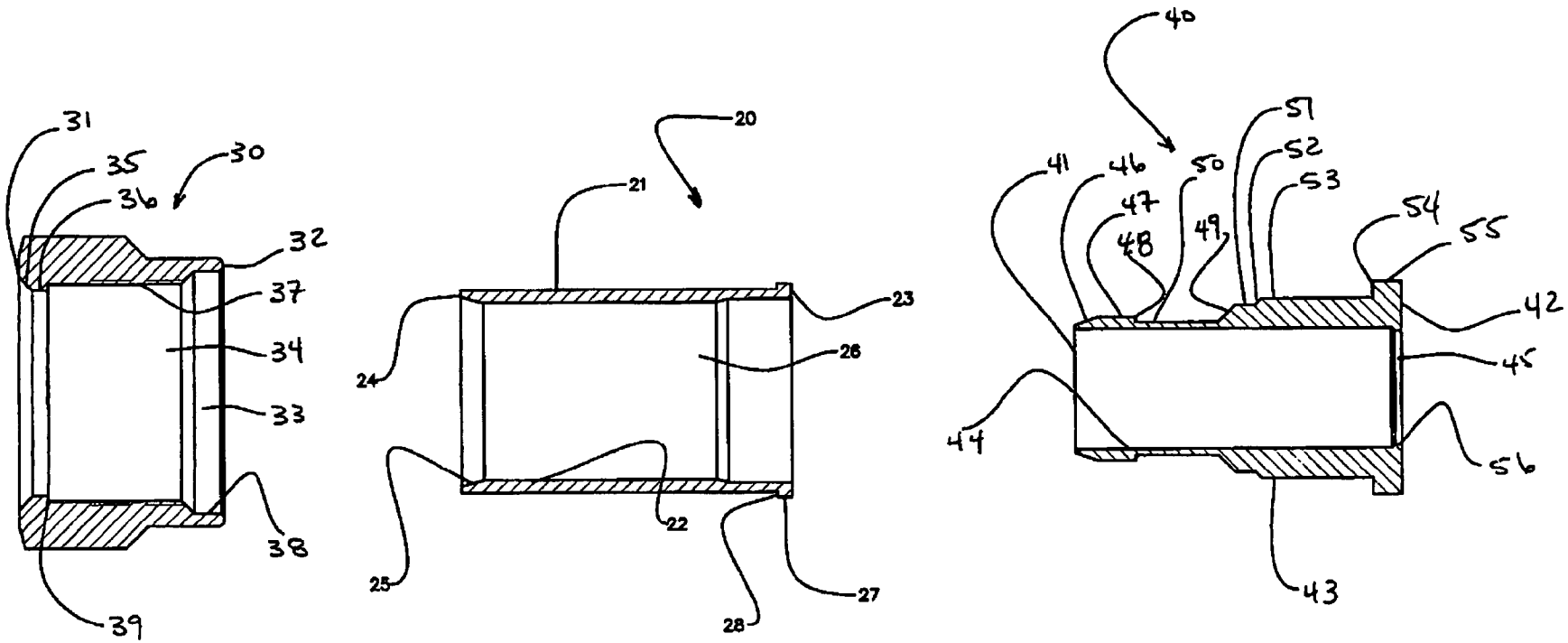
FIG. 4 is a cross sectional view of the components for a coaxial cable connector according to one embodiment of the present invention.

Referring to FIG. 4, the coaxial cable connector 10 comprises a tubular shell 20, a coupler 30, and a tubular post 40. The tubular shell 20 is preferably made from metal and plated with a non-corrosive material such as nickel. Alternatively, tubular shell 20 can be constructed from an engineering polymer, such as polyamides (e.g. nylon), polyesters, polyimides, and/or polysulfones. Coupler 30 is preferably made from a conductive material such as brass and is plated with a corrosion resistant material such as nickel. Alternatively, coupler 30 may be constructed from an engineering polymer. Tubular post 40 is preferably made from electrically conductive material, such as brass, and is preferably plated with a conductive material such as tin.

In some embodiments, the braid 104 is flared by a tool, or by angled surface 46 of post 40 which is driven under the braid 104 thereby further reducing cable preparation time and effort. Thus, folding back of braid 104 over the outside of the jacket 105 as found in known cable preparation methods is eliminated, thereby reducing the amount of skill and time to prepare the cable.

As seen in FIG. 4, tubular shell 20 is generally tubular and comprises outer surface 21, front end 23, back end 24, and an internal surface 22 defining internal bore 26 that extends between front and back ends 23, 24. It should be noted that the outer surface 21, the internal surface 22 or both the internal and the outer surfaces of shell 20 can have more than one diameter or shape as is illustrated in FIG. 4. It is also possible that the outer surface 21 and the internal surface 22 also have constant diameter portions over the entire length of shell 20. Internal surface 22 preferably has an internal chamfer 25 located adjacent back end 24 to assist the coaxial cable to enter the internal bore 26. Preferably, outwardly projecting annular rib 27 is disposed at the front end 23 forming backward facing annular face 28. As illustrated and discussed below in conjunction with FIG. 6A, the annular rib 27 need not be present on tubular shell 20.

Coupler 30 includes a back end 31, a front end 32, and an internal surface 33 defining internal bore 34. The coupler 30 shown in FIG. 4 is in the form of a coupling nut, wherein internal surface 33 includes an internal chamfer 35, an inwardly projecting annular ridge 36, internal threads 37, and an internal recess 38. The reduced diameter of annular ridge 36 defines a reduced diameter through-bore section 39 of internal bore 34. The increased diameter of internal recess 38 defines an increased diameter through-bore section 33 of internal bore 34. Coupler 30 may also take other forms in other embodiments.

Tubular post 40 is generally tubular and comprises back end 41, front end 42, outer surface 43, and internal surface 44 defining through-bore 45. It should also be noted that internal surface 44 and/or outer surface 43 can have differing diameters or shapes. Back end 41 of tubular post 40 is configured to be inserted into the end of the cable 100 preferably between braid 104 and shield 103. Front end 42 is adapted to engage shell 20, or alternately, partially engage coupler 30. The outer surface 43 of tubular post 40, as shown in FIG. 4, preferably includes an external tapered area 46 adjacent back end 41 leading to a first surface 47 preferably of constant diameter and an external annular face 48. A reduced diameter portion 50 is disposed between the annular face 48 and a first rearward-facing tapered portion 49. The reduced diameter portion 50 and annular face 48, as described below in more detail, assist in securing the jacket 105 and braid 104 within the coaxial cable connector 10. The tubular post 40 also preferably includes a constant diameter portion 51 between the first rearward-facing tapered portion 49 and a second rearward-facing tapered portion 52. A longer second surface 53 preferably of constant diameter extends between the second rearward-facing tapered portion 52 and a rearward facing annular surface 54 created by annular rib 55. The internal surface 44 of post 40 shown in FIG. 4 preferably comprises an inwardly projecting lip 56 which defines a reduced diameter through-bore portion of internal bore 45. In some embodiments, the angled surface of external tapered area 46 can be used to engage exposed length C of braid 104 as the post 40 and cable 100, preferably are driven together during assembly in order to lift at least a portion of exposed length C radially outward. Tubular post 40 may also take other forms in other embodiments.

Figure 5:
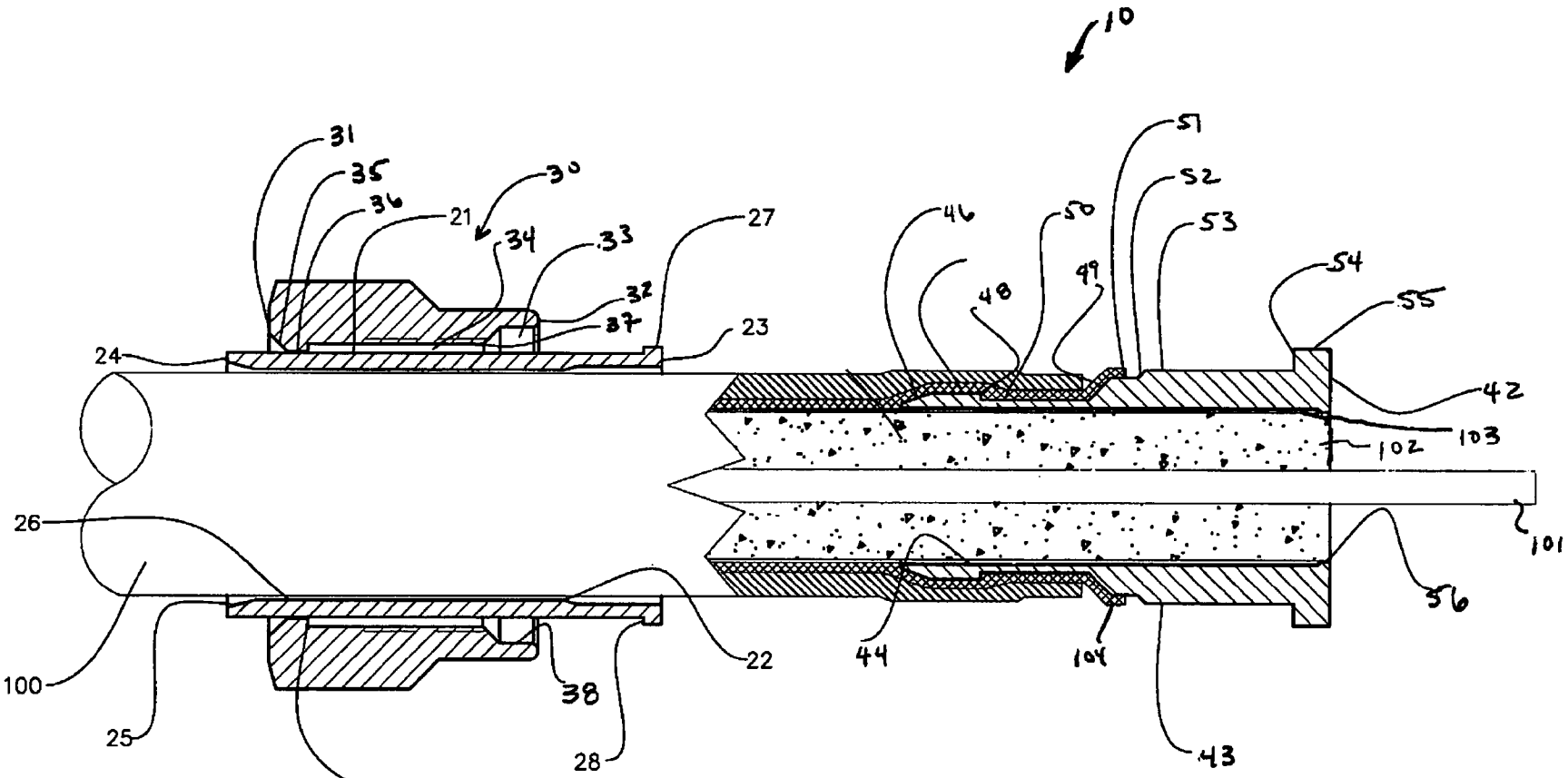
FIG. 5 is a cross sectional view of the components of the coaxial connector of FIG. 4 partially installed on a coaxial cable prepared according to a method disclosed herein.

FIG. 5 shows a side cutaway view of coaxial cable connector 10 partially installed on coaxial cable 100. Preferably, coupler 30 is first installed over the tubular shell 20 and then both coupler 30 and tubular shell 20 are installed over prepared cable 100 together. However, coupler 30 may first be installed over the prepared cable 100 and then tubular shell 20 is installed over the prepared cable 100. After the tubular shell 20 and the coupler 30 are installed on the prepared cable 100, back end 41 of post 40 is then inserted into cable 100 between the shield and the braid. In the embodiment shown in FIG. 5, coupler 30 is capable of rotating around the tubular shell 20, that is, the diametral relationship of outer surface 21 and bore 34 allows coupler 30 to rotate about shell 20 when coupler 30 is disposed about the tubular shell 20. Forward movement of coupler 30 relative to tubular shell 20 is restrained by engagement of annular rib 27 and backward facing annular face 28 with the reduced portion 39, thereby preventing coupler 30 from falling off from the front end 23 of shell 20.

In use, the end of coaxial cable 100 is brought together with tubular post 40, i.e. the back end 41 of tubular post 40, such that the cable outer conductor 103, dielectric 102 and center conductor 101 enter bore 44 of tubular post 40 such that cable 100 is impaled upon back end 41 of tubular post 40. In the embodiment shown in FIG. 5, the back end 41, external tapered area 46, the first surface 47, an external annular face 48, and reduced diameter portion 50 of tubular post 40 are driven between braided shield 104 and the outer conductor 103 of cable 100, preferably until the dielectric 102 at the end of the cable 100 is flush with the front end 42 of tubular post 40. Cable trim length as illustrated indicated in FIG. 3B is such that flared portion of cable braid 104 is forced into contact with, and may be shaped by, tapered portion 49 of tubular post 40. In this embodiment, a small protuberance of braid 104 extends radially outwardly and axially forwardly beyond tapered portion 49.

Figure 6:
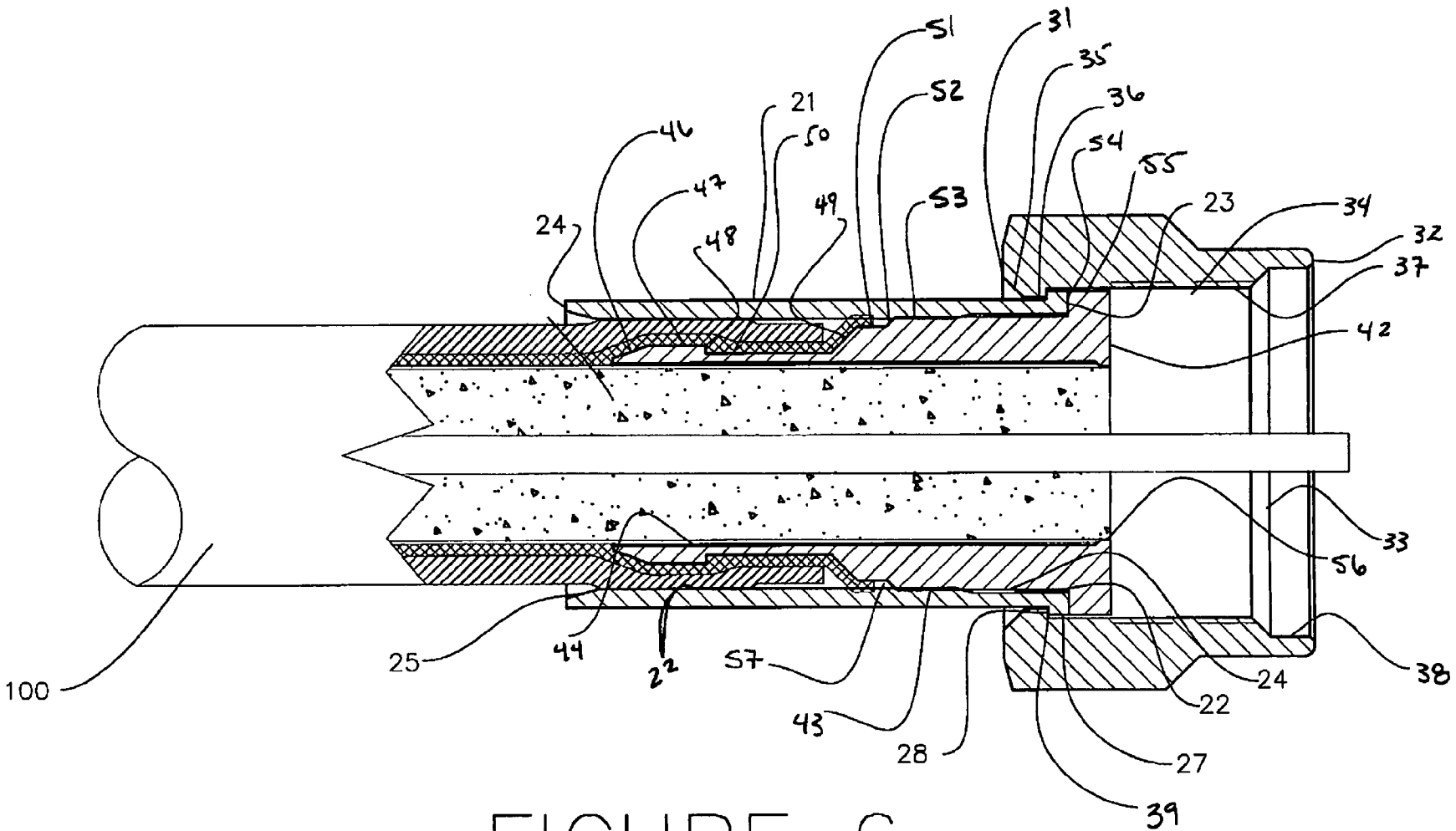
FIG. 6 is a cross sectional view of the coaxial cable connector of FIG. 4 fully installed on the coaxial cable, shown in partial cross-section.

Referring to FIG. 6 which shows the connection between coaxial cable connector 10 and the cable 100 in the completed, i.e. fully installed or fully compressed, state, wherein the tubular shell 20 is advanced axially forward to (i.e. toward the post 40) surround at least a part of tubular post 40 and cable 100. No further crimping or manipulation is required after tubular shell 20 is fully advanced. Upon advancement of the tubular shell 20, jacket 105 and braid 104 are preferably sandwiched between the tubular shell 20 and the tubular post 40, shown in FIG. 6 where internal surface 22 and first surface 47 of the outer surface 43 of tubular post 40 sandwich jacket 105 and braid 104. In some embodiments, a portion of braid 104 is disposed in an annular cavity formed between the inner surface of the tubular shell 20 and the outer surface of tubular post 40, and preferably seized therebetween, for example as seen in the annular cavity 57 shown in the embodiment of FIG. 6. Trapping and seizing of braid 104 within such annular cavity as cavity 57 can provide additional and improved electrical grounding and improved mechanical retention of braid 104 thereby improving electrical and mechanical communication between cable 100 and coaxial cable connector 10. When the connector in embodiments such as shown in FIG. 6 is fully installed on cable 100, rearward axial movement of coupler 30 may or may not be limited. Lip 56 can serve to both position (for example, center) and restrain further axial movement of cable dielectric 102 with respect to the tubular post 40.

Figure 6A:
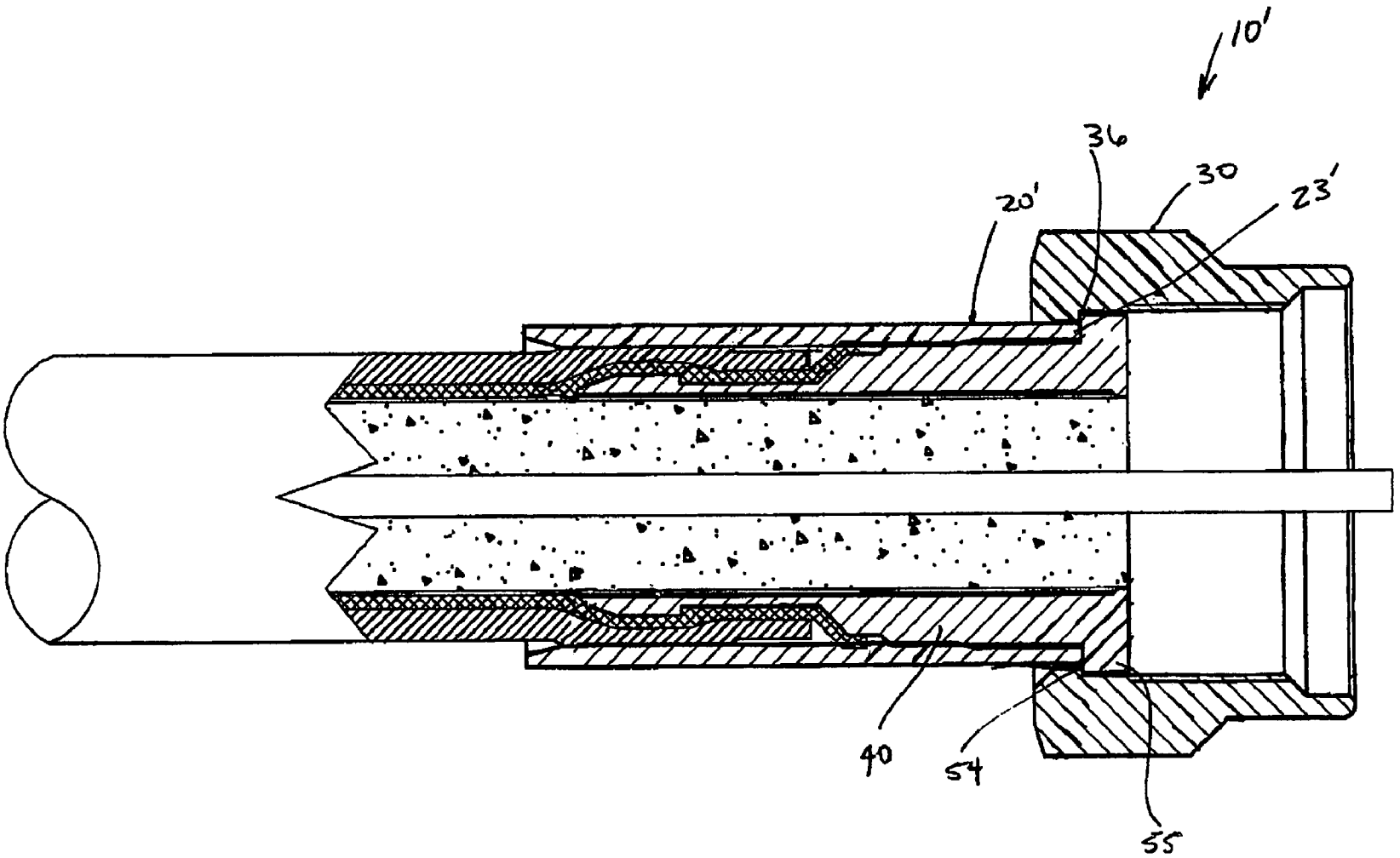
FIG. 6A is a cross sectional view of an alternative embodiment of the coaxial cable connector of FIG. 6 fully installed on the coaxial cable.

An alternative coaxial cable connector 10' is illustrated in FIG. 6A. The coaxial cable connector 10' is the same as coaxial cable connector 10 except that the tubular shell 20' has a smooth front end 23', i.e constant inner and outer diameters, and does not have the outwardly projecting annular rib 27 forming backward facing annular face 28 of the prior embodiment. As such, the inwardly projecting annular ridge 36 (and the reduced portion 39) of the coupler 30 engages the rearward facing annular surface 54 created by the annular rib 55 of the tubular post 40.

Figure 7:
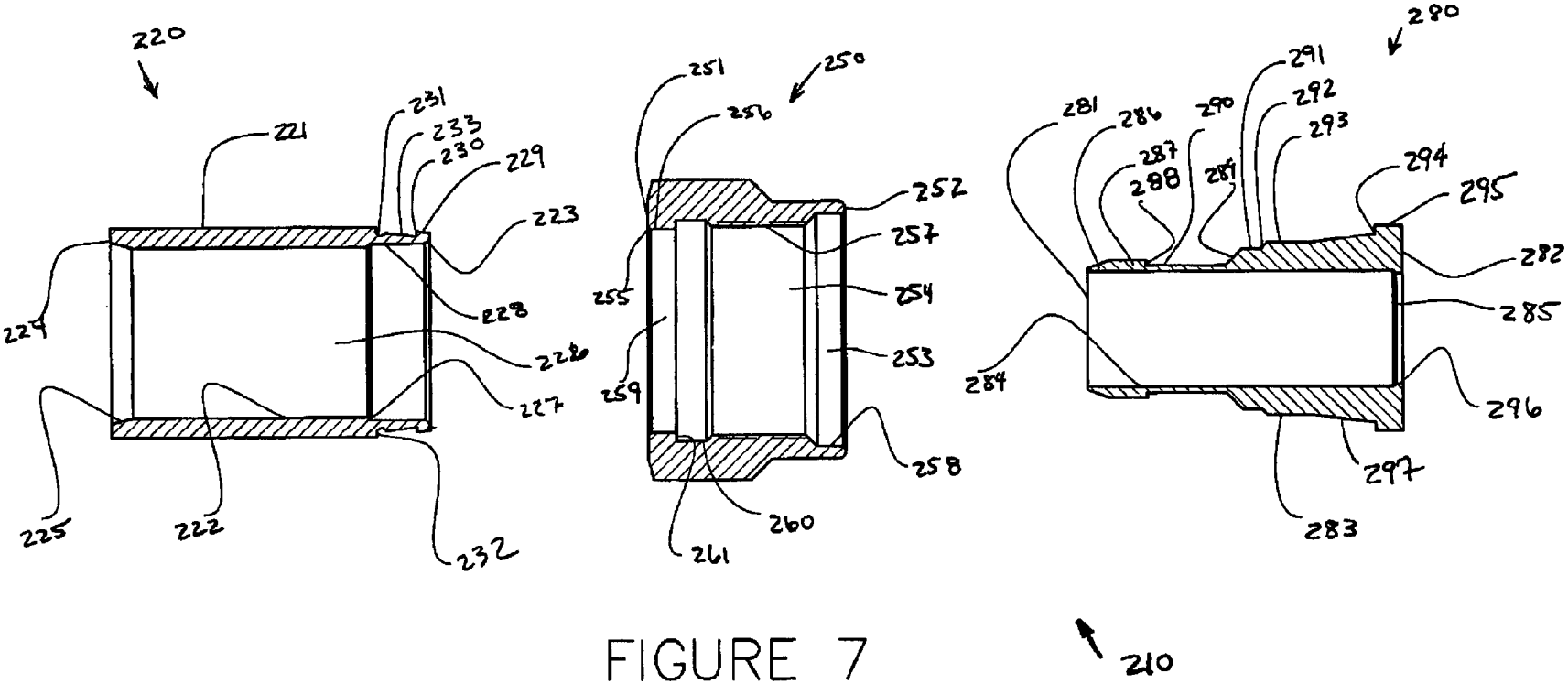
FIG. 7 is a cross sectional view of components for an alternative embodiment of a coaxial cable connector according to the present invention.

As seen in FIG. 7, another embodiment of a coaxial cable connector 210 comprises a tubular shell 220, a coupler 250, and a tubular post 290. The tubular shell 220 is preferably made from metal such as brass and preferably plated with a non-corrosive material such as nickel. Alternatively, tubular shell 220 can be constructed from an engineering polymer, such as polyamides (e.g. nylon), polyesters, polyimides, and/or polysulfones. Coupler 250 is preferably made from an electrically conductive material such as brass and is preferably plated with a corrosion resistant material such as nickel. Alternatively, coupler 250 may be constructed from an engineering polymer. Tubular post 290 is preferably made from conductive material, such as brass, and is preferably plated with a conductive material such as tin.

As seen in FIG. 7, tubular shell 220 is generally tubular and comprises outer surface 221, front end 223, back end 224, and an internal surface 222 defining internal bore 226 that extends between front and back ends 223,224. It should be noted that the outer surface 221, the internal surface 222 or both the internal and the outer surfaces of shell 220 can have more than one diameter or shape as is illustrated in FIG. 7. It is also possible that the outer surface 221 and the internal surface 222 also have constant diameter portions. Internal surface 222 preferably has an internal chamfer 225 located adjacent back end 224 to assist the coaxial cable to enter the internal bore 226. The internal surface 222 also preferably has a transition portion 227 that provides for a slightly larger diameter internal bore portion 228 adjacent the front end 223. Preferably a deformable lip 229 is disposed at front end 223 that forms a rearward facing surface 230. As explained in more detail below, the deformable lip 229 is expanded radially outward by the tubular post 290 to engage an annular recess in the coupler 250. An annular groove 231 is disposed in the outer surface 221 making a forward facing surface 232. An external, forward facing tapered surface 233 is positioned between the annular groove 231 and the rearward facing surface 230 formed by the deformable lip 229.

Coupler 250 includes a back end 251, a front end 252, and an internal surface 253 defining internal bore 254. The coupler 250 shown in FIG. 7 is in the form of a coupling nut, wherein internal surface 253 preferably comprises an internal chamfer 255, an inwardly projecting annular ridge 256, internal threads 257, and an internal recess 258. The reduced diameter of annular ridge 256 defines a reduced diameter through-bore section 259 of internal bore 254. The increased diameter of internal recess 258 defines an increased diameter through-bore section 253 of internal bore 254. Internal surface 253 preferably comprises an annular recess 260 and a frontward facing surface 261. Coupler 250 may also take other forms in other embodiments.

Tubular post 280 is generally tubular and comprises back end 281, front end 282, outer surface 283, and internal surface 284 defining through-bore 285. It should also be noted that internal surface 284 and/or outer surface 283 can have differing diameters or shapes. Back end 281 of tubular post 280 is configured to be inserted into the end of the cable 100 and preferably between braid 104 and shield 103. Front end 282 is adapted to engage shell 220, or alternately, partially engage coupler 250. The outer surface 283 of post 280, as shown in FIG. 7, preferably includes an external tapered area 286 adjacent back end 281 leading to a first surface 287 preferably of constant diameter and an external annular forward-facing surface 288. The annular forward-facing surface 288 and a first rearward-facing tapered portion 289 define a reduced diameter portion 290. The reduced diameter portion 290 and annular forward-facing surface 288, as described below in more detail, assist in securing the jacket 105 and braid 104 within the coaxial cable connector 210. The tubular post 280 also includes a second portion 291, preferably of constant diameter, between the first rearward-facing tapered portion 289 and a second rearward-facing tapered portion 292. A third surface 293, preferably of constant diameter, extends between the second rearward-facing tapered portion 292 and a third rearward facing tapered portion 297, which is adjacent to the rearward facing surface 294 created by annular rib 295. The internal surface 284 of post 280 shown in FIG. 7 preferably comprises an inwardly projecting lip 296 which defines a reduced diameter through-bore portion of internal bore 285. The angled surface of external tapered area 286 can be used to engage exposed length C of braid 104 as the cable as post 280 and cable 100 are driven together during assembly in order to lift at least a portion of exposed length C radially outward. Tubular post 280 may also take other forms in other embodiments.

Figure 8:
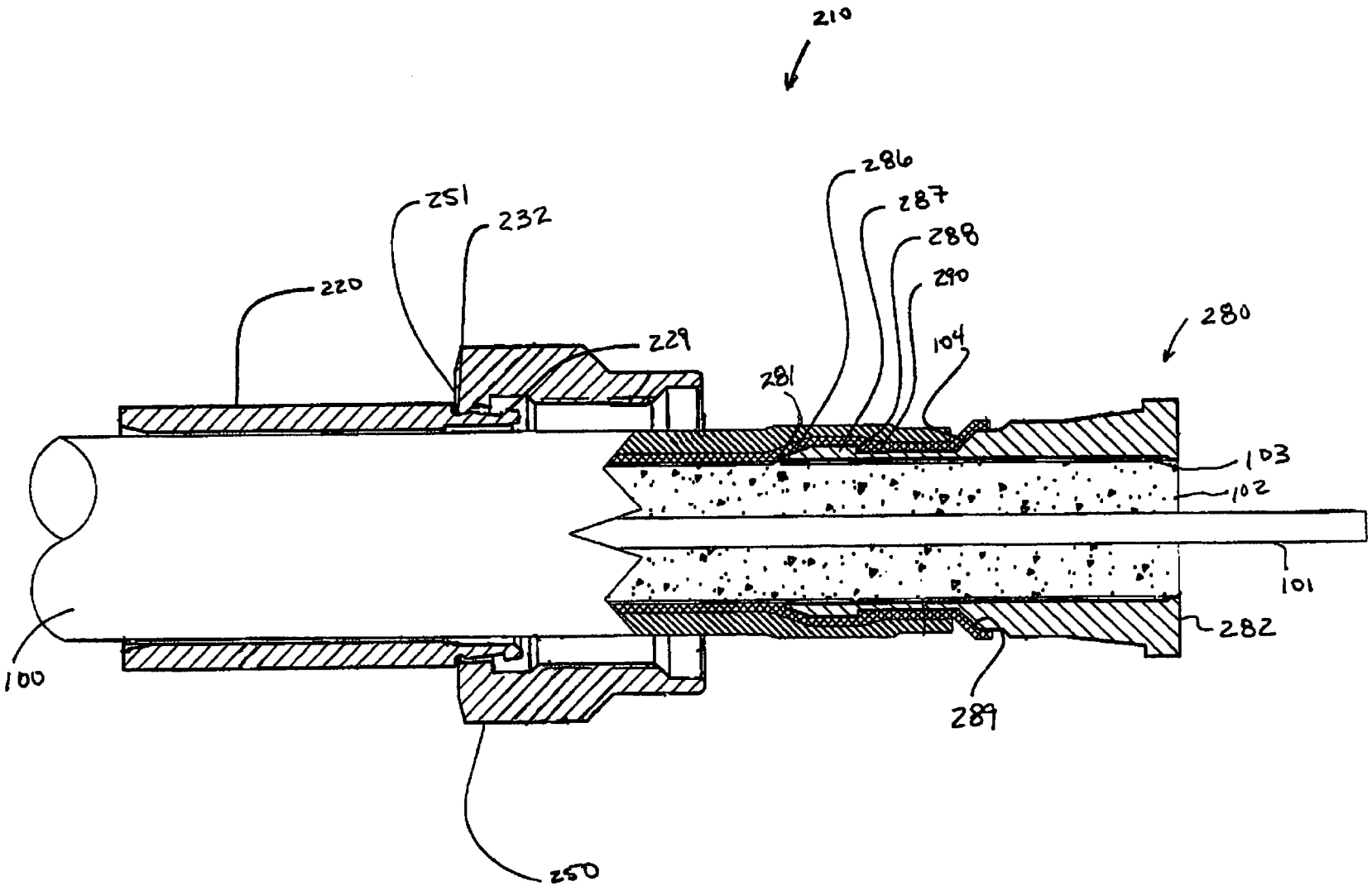
FIG. 8 is a cross sectional view of the components of the coaxial connector of FIG. 7 partially installed on a coaxial cable prepared according to a method disclosed herein.

FIG. 8 shows a partial cross sectional view of coaxial cable connector 210 partially installed on the coaxial cable. Tubular shell 220 is installed over prepared cable 100. Coupler 250 is installed over the tubular shell 220 either before or after the tubular shell 220 is installed on the prepared cable 100. After the tubular shell 220 and coupler 250 are installed on cable 100, back end 281 of tubular post 280 is then inserted into cable 100 between the shield and the braid. In the embodiment shown in FIG. 8, coupler 250 is capable of rotating around the tubular shell 220, that is, the diametral relationship of outer surface of the tubular shell 220 and bore 254 of the coupler 250 allows coupler 250 to rotate about shell 220 when coupler 250 is disposed about the tubular shell 220. Rearward movement of coupler 250 relative to shell 220 is restrained by engagement of forward facing surface 232 of the tubular shell 220 and the back end 251 of the coupler 250, thereby preventing coupler 250 from sliding backward toward the coaxial cable 100 and off the tubular shell 220. As described in more detail below, the deformable lip 229 will be moved radially outward by the tubular post 280 to engage the coupler 250 to prevent it from moving forward and slipping off of the tubular shell 250 in an axially forward direction.

In use, the end of coaxial cable 100 is brought together with tubular post 280, i.e. the back end 281 of tubular post 280, such that the cable outer conductor 103, dielectric 102 and center conductor 101 enter bore 285 of tubular post 280 such that cable 100 is impaled upon back end 281 of tubular post 280. In the embodiment shown in FIG. 8, the back end 281, external tapered area 286, the first surface 287, an external annular forward-facing surface 288, and reduced diameter portion 290 of tubular post 280 are driven between braided shield 104 and the outer conductor 103 of cable 100, preferably until the dielectric 102 at the end of the cable 100 is flush with the front end 282 of tubular post 280. Cable trim length as illustrated in FIG. 3B is such that flared portion of cable braid 104 is forced into contact with, and may be shaped by, tapered portion 289 of tubular post 280. In this embodiment, a small protuberance of braid 104 extends radially outwardly and axially beyond tapered portion 289.

Figure 9:
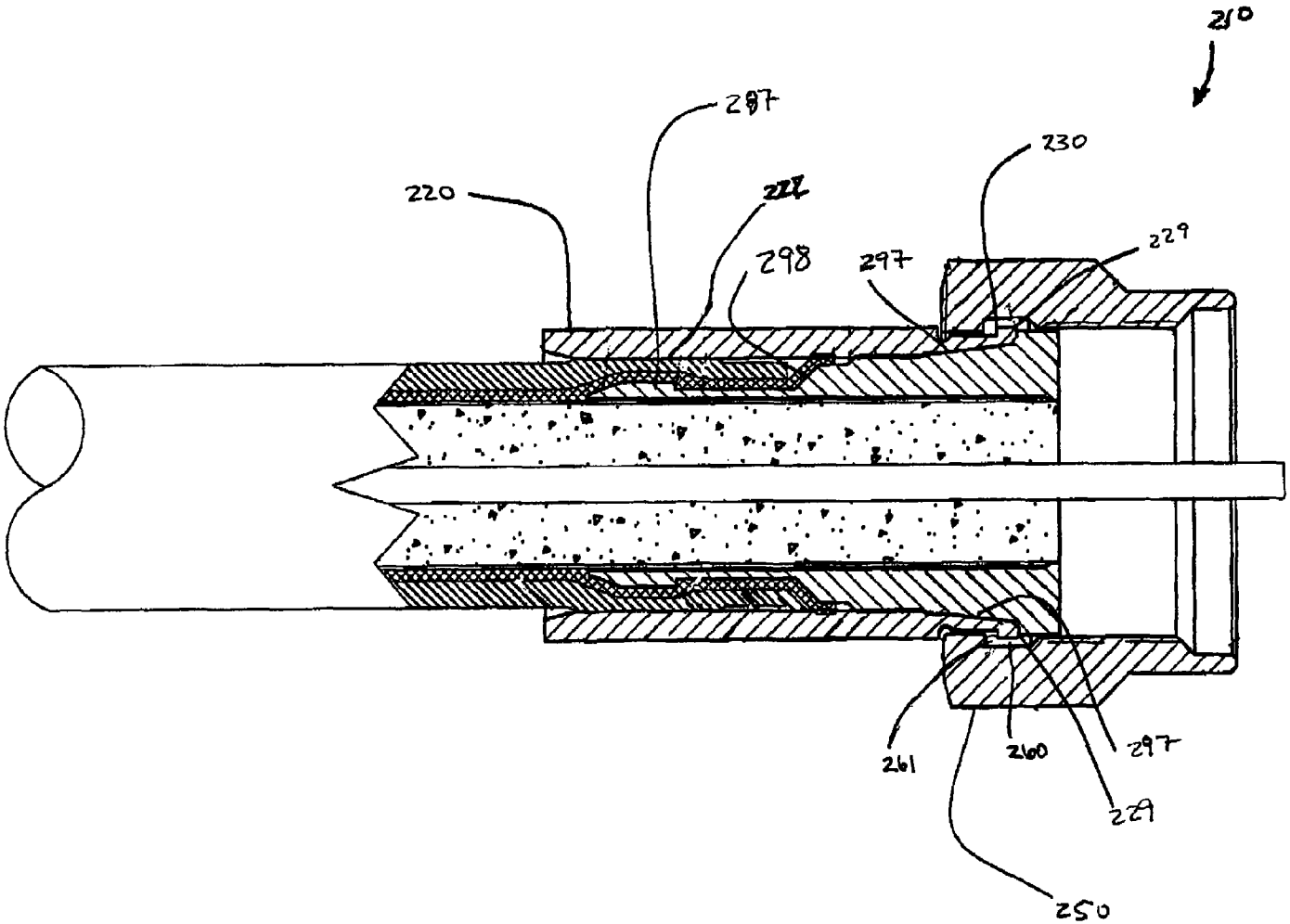
FIG. 9 is a cross sectional view of the coaxial connector of FIG. 7 fully installed on the coaxial cable.

FIG. 9 shows the connection between coaxial cable connector 210 and the cable 100 in the completed, i.e. fully installed or fully compressed, state, wherein the tubular shell 220 (and the coupler 250) is advanced axially forward to surround at least a part of tubular post 280 and cable 100. No further crimping or manipulation is required after tubular shell 220 is fully advanced. Upon advancement of the tubular shell 220, jacket 105 and braid 104 are preferably sandwiched between the tubular shell 220 and the tubular post 280, shown in FIG. 9 where internal surface 222 and flat surface 287 of tubular post 280 sandwich jacket 105 and braid 104. In some embodiments, a portion of braid 104 is disposed in an annular cavity formed between the inner surface of the tubular shell 220 and the outer surface of tubular post 280, and preferably seized therebetween, for example as seen in the annular cavity 298 shown in the embodiment of FIG. 9. Trapping and seizing of braid 104 within such annular cavity as cavity 297 can provide additional and improved electrical grounding and improved mechanical retention of braid 104 thereby improving electrical and mechanical communication between cable 100 and coaxial cable connector 210. Lip 296 can serve to both position (for example, center) and restrain further axial movement of cable dielectric 102 with respect to the tubular post 280.

As the tubular shell 220 is moved relative to the tubular post 280, the third rearward facing tapered portion 297 engages the forward portion 223 of the tubular shell 220, causing the deformable lip 229 to be moved radially outward and into the annular recess 260 of coupler 250. The frontward facing surface 261 of coupler 250 then engages the rearward facing surface 230 to prevent the coupler 250 from sliding off the coaxial cable connector 210 in the forward direction, but still allows, if so desired, the coupler to rotate relative to the tubular shell 220 and the tubular post 280.

After the shell 220, post 280 and coupler 250 are installed on cable 100, the resulting connector/cable combination, or assembly, can then be placed into contact with a terminal, such as a threaded terminal. Using the advantage found in increased exposure area E2 the coupler 250 may be tightened onto the threaded terminal for electrical and mechanical coupling of the coaxial cable 100.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A method of making a coaxial cable assembly, the method comprising:

passing an end of a coaxial cable through an internal bore in a tubular shell and an internal bore of a coupler, wherein the coaxial cable has a longitudinal axis;

inserting a first portion of a tubular post axially into the end of the coaxial cable, wherein the tubular shell and the coupler are axially spaced away from the first portion of the post, and the shell does not surround the first portion of the post; and after the inserting step, moving the tubular shell and the coupler axially relative to the post and the coaxial cable, wherein at least part of the tubular shell surrounds at least part of the tubular post and wherein at least a portion of the coupler surrounds at least a part of the tubular shell and the coaxial cable.

2. The method of claim 1, wherein the coupler has a threaded internal surface.

3. The method of claim 1, wherein the tubular shell limits axial movement of the coupler.

4. The method of claim 1, wherein the tubular shell limits axial movement of the coupler in two directions.

5. The method of claim 1, wherein the tubular post limits axial movement of the coupler.

6. The method of claim 1, wherein, after the moving step, part of the coaxial cable is sandwiched between the shell and the post.

7. The method of claim 1, wherein, in the moving step, a portion of the tubular shell is pushed outward to engage the coupler by the coaxial cable and tubular post.

8. The method of claim 1, wherein at least part of the tubular shell is disposed in the internal bore of the coupler prior to passing the coaxial cable through the internal bore of the tubular shell.

9. A method of making a coaxial cable assembly, the method comprising:

passing an end of a coaxial cable through an internal bore in a tubular shell and an internal bore of a coupler;

inserting a tubular post into the end of the coaxial cable, wherein the tubular shell and the coupler are spaced away from the post, and the shell and the coupler does not surround the post; and after the inserting step, moving the shell and the post together sufficient to surround at least part of the post with at least part of the shell.

10. The method of claim 9, further comprising the step of moving the coupler towards the end of the coaxial cable.

11. The method of claim 9, wherein the moving step further comprises bringing the shell into mechanical contact with the post.

12. The method of claim 11, wherein, in the moving step, at least part of the raised portion of the cable is disposed between the at least part of the post and the at least part of the shell.

13. The method of claim 9, wherein, after the moving step, the shell limits movement of the coupler.

14. The method of claim 9, further comprising, before the inserting step, mounting a coupler on the shell.

15. The method of claim 14 wherein the coupler is rotatably mounted on the shell.

16. A method of making a coaxial cable assembly, the method comprising:

providing a length of coaxial cable having an end, the cable comprising an inner conductor and outer components surrounding the inner conductor, the outer components comprising a first outer component surrounded by a second outer component;

providing a tubular shell, a tubular post, and a coupler;

inserting the end of the cable into a first end of the tubular shell;

inserting a back end of the tubular post into the end of the cable, wherein the back end is wedged between the first outer component and the second outer component of the cable;

moving the tubular shell axially toward a front end of the post sufficient for the shell to surround at least a portion of the tubular post, thereby causing the shell and the post to transmit a compressive force to the second outer component sufficient to secure the shell and the post onto the cable.

17. The method of claim 16, wherein the moving step causes a portion of the tubular shell to be moved radially outward and engage a portion of the coupler.

18. A coaxial connector comprising:

a tubular shell, the tubular shell having an internal bore to receive a coaxial cable therethrough and a lip at a front end;

a tubular post having an internal bore to receive at least a portion of the coaxial cable, the tubular post also having an outer surface and an annular collar configured to engage the front end of the tubular shell; and a coupler having an internal bore to receive the coaxial cable and at least a portion of the tubular shell therein, the internal bore having an annular recess;

wherein in a fully compressed position the lip on the tubular shell is deflected radially outward and into the annular recess of the coupler by contact between the tubular shell and the tubular post and the tubular shell is press fit onto the tubular post.

19. The coaxial connector of claim 18, wherein the coupler is rotatable around the tubular shell and the tubular post.

20. The coaxial connector of claim 18, wherein the tubular shell has an outer surface, an annular recess in the outer surface, and wherein a portion of the coupler is disposed in the annular recess of the tubular shell sufficient to limit the coupler from moving in a rearward direction.

* * * * *